United States Patent [19]

Bailey, Jr.

[11] Patent Number: 4,460,892

[45] Date of Patent: Jul. 17, 1984

[54] METHOD AND APPARATUS FOR DETECTING CHANGES IN LIGHTING INTENSITY UTILIZING A MICROPROCESSOR

[76] Inventor: Cornelius E. Bailey, Jr., 1816 30th St. SE., Washington, D.C. 20020

[21] Appl. No.: 314,332

[22] Filed: Oct. 23, 1981

[51] Int. Cl.[3] ..... G08B 13/18

[52] U.S. Cl. ..... 340/555; 340/600; 364/550

[58] Field of Search ..... 340/555, 600, 568, 589; 364/555, 570, 550

[56] References Cited

U.S. PATENT DOCUMENTS

| | | | |
|---|---|---|---|
| 4,101,876 | 7/1978 | Lurkis et al. | 340/555 |
| 4,199,753 | 4/1980 | Gontowski, Jr. | 340/555 |
| 4,317,112 | 2/1982 | Beier et al. | 340/568 |

*Primary Examiner*—Glen R. Swann, III

*Attorney, Agent, or Firm*—Robert P. Gibson; John E. Becker

[57] ABSTRACT

Apparatus for measuring the ambient light intensity of a monitored area during consecutive time intervals whereby an indication is given whenever the difference in any one of these measurements and the immediately preceeding measurement exceeds a predetermined value. The output signal of a suitable light sensing device such as a photocell is converted to a pulse train having a frequency proportional to the ambient light level and supplied to one input of an AND gate. The other input of the AND gate is connected to receive consecutive, equal duration, timing signals generated by a one shot timer circuit controlled by a microprocessor. The output of the AND gate supplies a finite number of pulses to a pulse counter, also controlled by the microprocessor. The pulse counter supplies numerical values, corresponding to the ambient light level of the monitored area during consecutive equal time periods, to the microprocessor, which computes the absolute value of the difference between each numerical value and the preceeding value, and activates an alarm or indicator circuit whenever the difference exceeds a preselected value stored in the microprocessor. Relative to measuring changes in physical quantities as sensed by devices with proportional outputs, i.e. light, sound and pressure quantities, the novel method facet hereof economically translates the above changes into data for an observer to analyze, or from which to initiate appropriate corrective or other procedural actions.

9 Claims, 5 Drawing Figures

FIG. 3
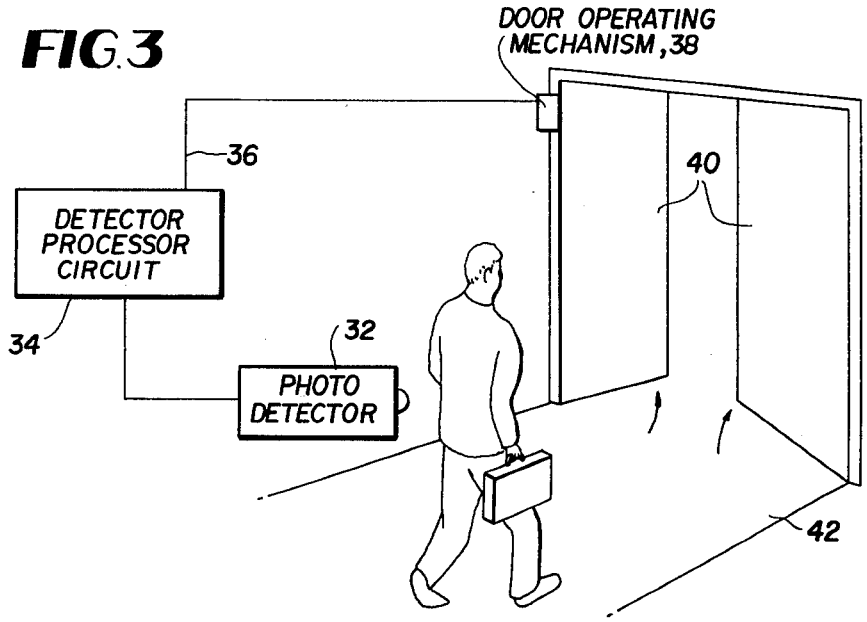
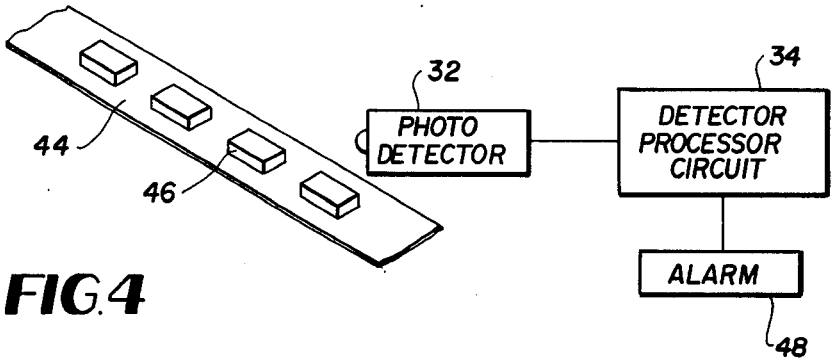
FIG. 4
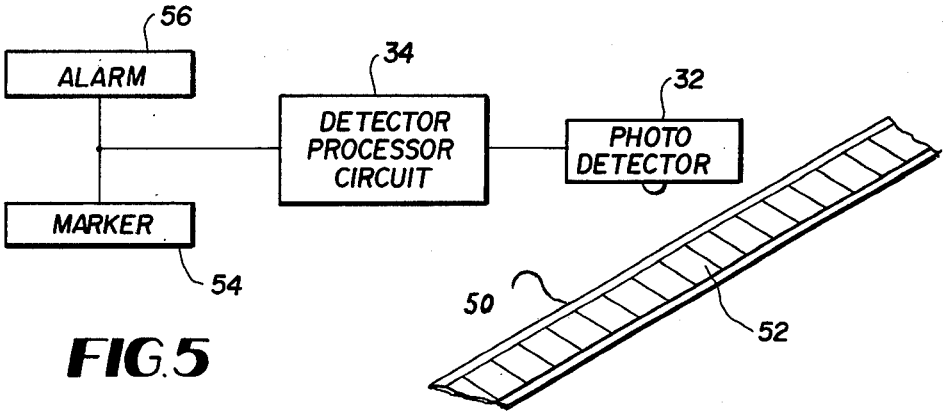
FIG. 5

METHOD AND APPARATUS FOR DETECTING CHANGES IN LIGHTING INTENSITY UTILIZING A MICROPROCESSOR

STATEMENT OF GOVERNMENT INTEREST

The invention described herein may be manufactured, used, and licensed by or for the U.S. Government for governmental purposes without the payment to me of any royalties thereon.

BACKGROUND OF THE INVENTION

The invention relates to a method and apparatus for detecting changes in light intensity, and more particularly, to a method and apparatus for detecting certain changes in the ambient light intensity of a monitored scene or area which exceeds a predetermined value.

In a known video alarm system, described in U.S. Pat. No. 4,198,653, to Kamin, issued Apr. 15, 1980, the television picture produced by a television camera monitoring a protected area is sub-divided into a plurality of areas which are individually evaluated to determine whether or not an alarm is to be raised. To avoid false alarms by fluctuations in the ambient lighting of the area, for example, by intermittent cloud cover, a particular area of the picture is investigated for variation in average brightness. If a brightness should change greater than a predetermined threshold as detected in this selected area, any alarm initiated by the alarm system is suppressed.

In another known system for detecting changes in light intensity, described in U.S. Pat. No. 4,199,753 to Walter S. Gontowski, Jr., issued Apr. 22, 1980, a photodiode, which is disposed to sense the light intensity of a protected area, generates a direct current signal which is proportional to the ambient light intensity of the protected area. This current signal is amplified by an amplifier having a logarithmic transfer function so that a given percentage change in light intensity at low ambient levels will produce substantially the same amplifier output signal change as would a given percentage change in light intensity at much higher ambient light levels. The output of this amplifier is connected through a capacitor to a threshold detector device which generates an alarm signal whenever the varying components of the amplified photo-current signal within a predetermined frequency range (e.g. 0.6 Hz to 9 Hz) exceeds a fixed threshold value.

OBJECTS AND SUMMARY OF THE INVENTION

It is an object of the invention to provide a method for measuring the light intensity of a monitored area during consecutive equal time intervals, and indicating whenever the difference between any one of these measurements and the preceeding measurement exceeds a preselected value.

It is another object of the invention to provide area surveillance apparatus which includes a light sensor circuit, controlled by a microprocessor, for providing light intensity values at consecutive equal time intervals to the microprocessor which compares each value with the preceeding value to indicate whenever the absolute difference between any light intensity value and the immediately preceeding light intensity value exceeds a preselected constant value.

It is a further object of the invention to disclose such an apparatus in which the values provided by the light sensing circuit to the microprocessor are processed as digital signals.

It is still another object of the invention to provide area surveillance apparatus which may be utilized as a replacement for the universally accepted photoelectric relay, and which may be used for the same purposes as prior known photoelectric relays, such as opening and closing doors, counting objects on the assembly line, surface defects or surface change detection, or the like.

In a preferred embodiment of the invention numerical values corresponding to the ambient light level of a monitored area during consecutive time periods of equal duration are stored in a microprocessor, which computes the absolute value of the difference between each ambient light level value and the preceeding ambient light level value. Whenever the absolute value of the difference between any of these ambient light level values and the preceeding ambient light level value exceeds a selected, stored reference value, the microprocessor activiates an alarm or indicator circuit. So long as the absolute value of the difference between consecutive ambient light level values does not exceed the stored reference value, the microprocessor controlled detection system operates in a continuous mode, constantly making and comparing sample measurements of the ambient light levels.

The area surveillance apparatus described herein may be used in any system for producing a predetermined effect or result in response to sudden change in the ambient light level of an area monitored by the surveillance apparatus. For example, this surveillance apparatus may be incorporated in intruder detection systems, automatic door operators, quality control equipment for detecting surface or thickness defects in manufactured products, or counting systems for counting the number of objects passing through the monitored area, such as objects moved by a conveyor system, vehicles moving along a particular road or track, and the like.

The invention will be better understood, as well as further objects and advantages will become more apparent, from the ensuing detailed description of the preferred embodiments, taking in conjunction with the drawings.

BRIEF DESCRIPTION OF THE DRAWINGS

FIG. 3 is a schematic view showing the invention utilized in a manner to effect automatic opening and closing of doors.

FIG. 4 is a schematic view showing the utilization of the invention as a means of object detection for purposes of counting objects, as on a conveyor; and FIG. 5 is a further schematic view showing the utilization of the invention for detecting surface defects or surface changes; and the like.

DESCRIPTION OF THE PREFERRED EMBODIMENT

Figure 1:
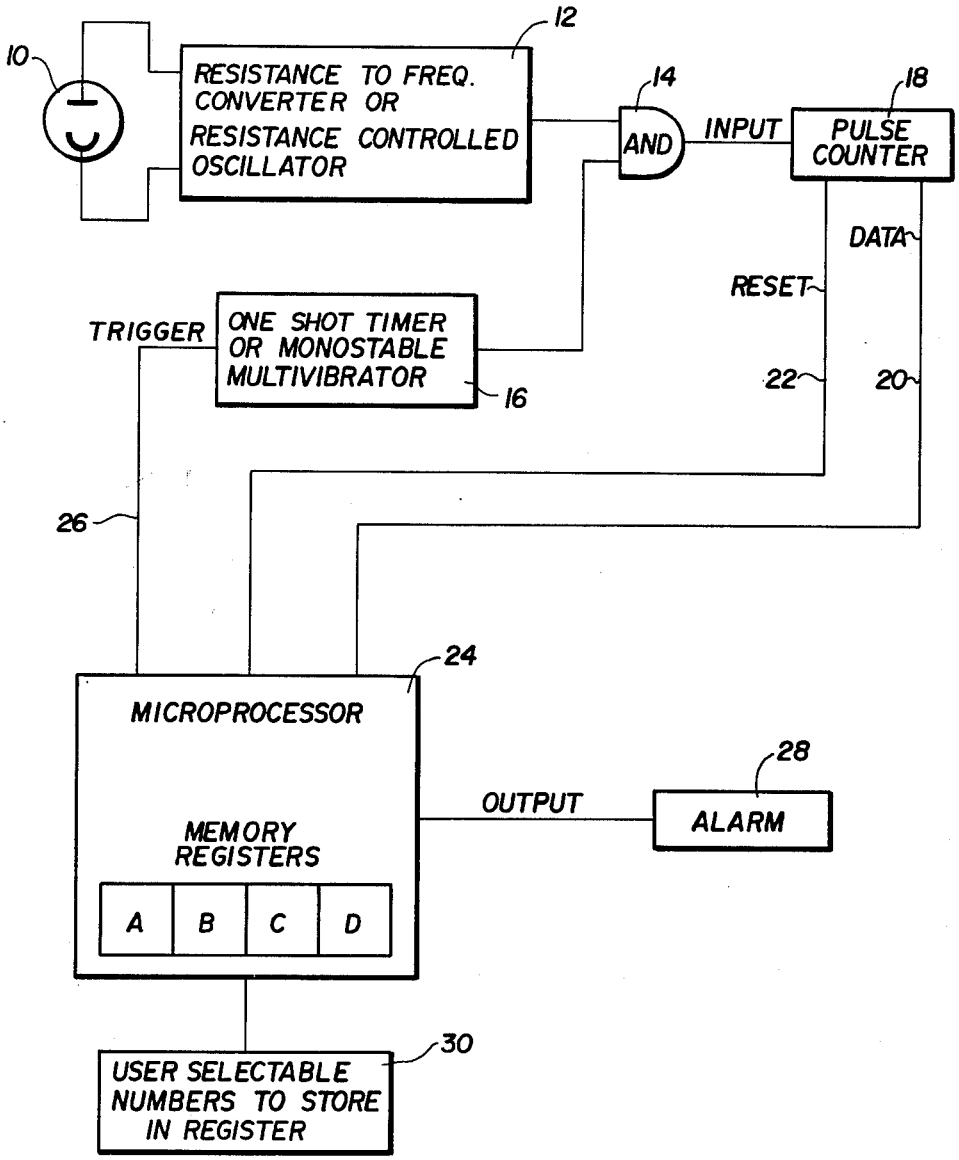
FIG. 1 is a block diagram of a preferred embodiment of the invention.

The detector system shown in FIG. 1 includes a photocell 10 which has a resistance which varies inversely with light intensity and which is connected across the inputs of a resistance-to-frequency converter or resistance controlled oscillator 12 which produces at its output a TTL compatible pulse train. The pulse train frequency is inversely proportional to the resistance of the photo-cell 10, or directly proportional to the intensity of the ambient light within the viewing area of the photocell 10. An AND gate 14 has a first input connected to receive the pulse train generated by the resistance-to-frequency converter 12, a second input connected to a one shot timer, or monostable multivibrator 16, and an output connected to the input of a pulse counter 18. The pulse counter 18 includes a data output and a reset circuit which are connected by respective connecting lines 20, 22, to a microprocessor 24, which is also connected to trigger the one shot timer 16 by another connecting line 26. The output of the microprocessor 24 is connected to actuate an alarm 28. The microprocessor 24 includes four memory registers A, B, C, D. The memory register C is connected to receive a number selected by the user from a plurality of reference numbers stored in the reference register 30.

During operation of the system, the microprocessor 24, which is the master processor for the detection system, sequentially resets the pulse counter 18, triggers the one shot timer 16, transfers the data from the pulse counter 18 to its random access memories A, B, C, or D, performs subtraction and comparison operations on the stored data of the pulse counter 18, and determines from these comparison operations whether to activate the alarm 28.

Figure 2:
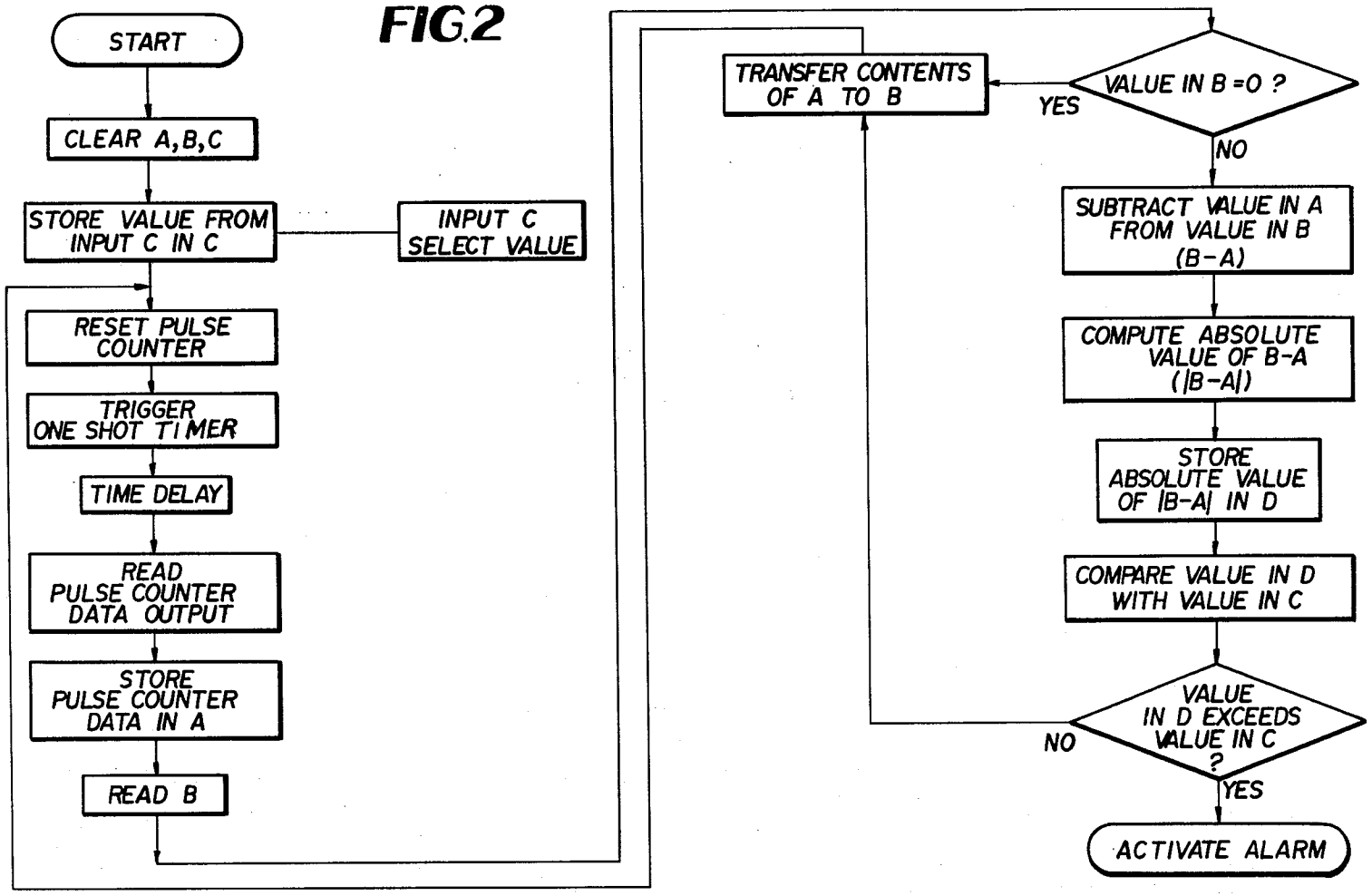
FIG. 2 is an algorithm or flow chart depicting the operating cycles of the detector system of FIG. 1.

The various functions which the microprocessor is programmed to perform, as well as the order in which these functions are performed is shown in the algorithm of FIG. 2. Thus, after power is applied to the system, the microprocessor 24 is programmed to erase the contents of the memory registers A, B, C as a preparation for system operation, and thereafter to store, in the memory register C, the reference value which has been selected by the user from the plurality of reference values stored in the register 30, and which sets the sensitivity level of the detector system. Next, the microprocessor 24 resets the pulse counter 18 to zero as a preparation for the first operational cycle of the detection system.

Thereafter, the microprocessor 24 triggers the one shot timer 16 to initiate an operating cycle of the detector system. The one shot timer 16 generates a single, fixed duration, square wave pulse that, when gated into the AND gate, allows the pulse counter to count the pulses in the pulse train generated by the resistance-to-frequency converter 12. The duration of the output pulse of the one shot timer 16 determines the duration of the pulse counting period of the pulse counter 18.

After the pulse counter 18 has completed its fixed duration counting cycle, the microprocessor reads the number of pulses counted by the pulse counter during its counting cycle, and stores this number in the memory register A. Next, the microprocessor reads the contents of the memory register B, and compares the value of register B content to zero. If the value stored in the memory register B is equal to zero, the microprocessor transfers the number stored in the memory register A to the memory register B, and thereafter resets the pulse counter to zero to initiate a subsequent operating cycle.

If the value of the contents stored in the memory register B does not equal zero, the microprocessor automatically subtracts the number stored in the memory register A from the number stored in the memory register B, to determine a difference value, from which the microprocessor then computes an absolute value of the difference of the two numbers stored in the memory registors A and B, which is then stored in the memory register D.

The microprocessor 24 then compares the numbers stored in the memory register D with the number stored in the memory register C. If the number stored in the memory register D exceeds the number stored in the memory register C, the microprocessor activates an appropriate device such as an alarm or an electronic circuit. If the number stored in the memory register D does not exceed the number stored in the memory register C, the microprocessor 24 transfers the contents of the memory register A to the memory register B, and thereafter resets the pulse counter 18 to initiate the next operational cycle of the detector system.

Commercially-available devices and circuits may be used for the various circuit elements shown in FIG. 1 and described herein. For example, a Motorola Type MC6800 microprocessor may be used for the microprocessor 24; a type LM555 timer may be used for the resistance-to-frequency converter 12; one gate of a type SN7408 quad two-input AND gate may be used for the AND gate 14; a type SN7490 decade counter may be used for the pulse counter 18; a type SN74121 monostable multivibrator may be used for the one shot timer 16; a Cherry type T2002A thumb wheel switch may be used for the register 30; and a Clairex type VT-521H photocell may be used for the photocell 10.

As used herein, the term "monitored area" applies to any area at which the detection of a sudden change in the ambient light intensity can be used to produce a desired effect or result. For example, the surveillance apparatus described herein may be used to monitor a protected area which is under military or civilian security surveillance, as well as other areas such as various commercial or governmental production line equipment and the like.

In FIGS. 3 through 5 illustrating various applications or uses of this invention, the detection system described above in connection with FIG. 1 is shown in simplified form as a photo detector 32, including the photo-cell 10, which is connected to a detector and processor circuit 34 including the remaining elements 12–30 of the detector system, in which the output of the microprocessor 24 is identified by the numeral 36.

In FIG. 3, the output 36 of the detector processor circuit 34 is connected to a door operating mechanism 38 for opening or closing a pair of doors 40 disposed in a passageway 42. The photo detector 32 is installed adjacent to the passageway 42 in such a manner that the presence of a person or object coming in a predetermined proximity of the photo detector 32 is detected by the detector system as a whole, which activates the door operating mechanism 38. The output 36 of the detector processing circuit 34 can be connected to the door operating mechanism 38 to either open or close the door 40, depending upon which mode of operation is desired.

In the application of the invention shown in FIG. 4, the photo detector 32 is installed alongside a moving conveyor belt 44 in sufficient proximity to objects 46 carried by the conveyor belt 44 so that these objects 46 can be monitored either for purposes of defect determination or for numerical counting. When the detector system is used for the purpose of counting the number of objects 46 passing by the photo detector 32, the output of the detector and processor circuit 34 is connected to actuate a counter (not shown). When the detector system is used for purpose of determining defects in the objects 46, the output is connected to actuate an indicator or alarm 48, in lieu of the aforesaid counter.

The detector system described herein may also be used to detect surface defects or changes of a web type material or product undergoing surveillance. For example, in the application of the invention illustrated in FIG. 5, the photo detector 32 is installed adjacent a moving conveyor 50 in close proximity to the surface of a web type product 52 such as paper webs, steel webs, plastic sheet webs, etc., carried by the conveyor 50. In this application, the detector system will detect changes in the surfaces of the web type product 52 which are moved in close proximity past the photo detector portion of the detector system. When such changes are detected, the detector system will activate a marker device 54 for applying a mark at the detective portion of the web material 52, and/or will activate an alarm circuit 56 to stop movement of the conveyor 50 until appropriate remedial action is taken or subsequently noted.

Since various modifications, variations, and adaptations can be made to the preferred embodiment of the invention described herein, it is intended that the scope of the invention be limited only by the appended claims.

What is claimed and desired to be secured by Letters Patent of the United States is:

1. A method of monitoring an area to detect sudden changes in the ambient light level thereof, which comprises the steps of:

measuring the ambient light level of the area for successive equal time periods;

subtracting the ambient light level measurement of each time period from the ambient light level measurement of the preceeding time period, or visa versa, to obtain as a difference value an absolute value of the difference between the two ambient light level measurements, whenever the preceeding ambient light level measurement is equal to a value other than zero;

comparing the difference value with a predetermined value; and indicating whenever the difference value exceeds the predetermined value, to thus indicate a sudden change in the ambient light level of the area which exceeds a predetermined value.

2. A method, as described in claim 1, further including utilizing said indicated change in the ambient light level to produce a predetermined effect or result.

3. A method, as described in claim 1, wherein the step of measuring the ambient light level of the area during successive equal time periods comprises the steps of:

continuously measuring the instantaneous value of the ambient light level of the area;

converting the instantaneous ambient light level value to a pulse train having a frequency or period proportional to the instantaneous value of the ambient light level;

counting the number of pulses in the pulse train during each time interval, to produce consecutive values which constitute the consecutive measurements of the ambient light level of the area during the consecutive time periods.

4. A method, as described in claim 3, wherein the step of obtaining the absolute value of the difference between each ambient light level measurement and the preceeding ambient light level measurement further comprises the steps of:

storing each ambient light level value in a first memory means;

reading a value stored in a second memory means;

if the value read from the second memory means is equal to zero, transferring the value in the first memory means to the second memory means;

if the value read from the second memory means does not equal zero, subtracting the value in the first memory means from the value read from the second memory means to obtain the difference;

converting the difference value to an absolute value; and storing the absolute value in a third memory means as said difference value.

5. A method as described in claim 4, wherein the step of comparing the difference value with the predetermined value further comprises the steps of:

before initiating surveillance of the area, storing the predetermined value in a fourth memory means;

comparing the difference value stored in the third memory means with the predetermined value stored in the fourth memory means;

if the difference value is less than the predetermined value, transferring the value stored in the first memory means to the second memory means; and if the difference value exceeds the predetermined value, generating a signal to indicate a sudden change in the ambient light level of the area which exceeds the predetermined value.

6. Area surveillance apparatus for monitoring a protected area to detect sudden changes in the ambient light level thereof, which comprises:

light monitoring means for generating light level values indicating the ambient light level of the protected area during consecutive time periods of equal duration; and computer means, connected to receive the light level values, for indicating whenever the absolute value of the difference between one value and an immediately preceeding value other than zero is greater than a preselected value.

7. Area surveillance apparatus, as described in claim 6, wherein the computer means further comprises:

first memory means for initially storing each light level value upon receipt of this value from the computer means;

second memory means;

reading means for reading the contents of the second memory means upon receipt of a light level value from the first memory means;

first comparison means for comparing the value read from the second memory means with zero;

transfer means for transferring the value stored in the first memory means to the second memory means whenever the first comparison means indicates that the value read from the second memory means is zero;

processing means for subtracting the value stored in the first memory means from the other value stored in the second memory means to obtain an absolute difference value, i.e., the absolute value of the difference between the two stored values, when the first comparison means indicates that the value stored in the second memory means is a value other than zero;

third memory means for storing the preselected value;

second comparison means for comparing the absolute difference value with the preselected value, wherein the transfer means transfers the value stored in the first memory means to the second memory means whenever the absolute difference value is less than the preselected value; and indicator means for providing indication whenever the absolute difference value exceed the preselected value.

8. Area surveillance apparatus, as described in claim 6, wherein the light monitoring means further comprises:

light sensing means, disposed to receive ambient light from the protected area, for generating a pulse train having a frequency which is directly proportional to the ambient light level of the protected area;

timing circuit means having an input and an output, for generating an output signal of precise, constant duration upon receipt of a triggering signal at its input;

pulse counter means for counting the number of pulses in a pulse train supplied to the pulse counter means;

an AND gate means, having a first input connected to receive the pulse train generated by the light sensing means, a second input connected to receive the timing signal generated by the timing circuit, and an output connected to an input of the pulse counter means, wherein when the timing circuit is triggered, the pulse train generated by the light sensing means is received and counted by the pulse counter means for a precise period of time determined by the timing circuit;

timing means for continuously and in sequence resetting the pulse counter means to zero, triggering the timing circuit, and reading the pulse count stored by the pulse counter means after a period of time at least equal to the duration of the timing circuit output signal, wherein the pulse counts read from said pulse counter means constitute the light level values.

9. Area surveillance apparatus, as described in claim 8, wherein said light sensing means includes a photo-cell which is disposed to receive ambient light from the protected area and which has a resistance which varies inversely with light intensity; and a resistance-to-frequency converter means having an input connected to the photo-cell and an output, for producing a pulse train output signal whose frequency is inversely proprotional to the resistance of the photo-cell, and thus directly proportional to the ambient light level of the protected area.

* * * * *